US012790778B2

(12) United States Patent
Cope et al.

(10) Patent No.: US 12,790,778 B2
(45) Date of Patent: Nov. 10, 2026

(54) SAFETY BOLLARD

(71) Applicant: SBI Industrial, LLC, Canton, TX (US)

(72) Inventors: Michael Dean Cope, Terrell, TX (US); John Krawietz, Canton, TX (US)

(73) Assignee: SBI INDUSTRIAL LLC, Canton, TX (US)

( * ) Notice: Subject to any disclaimer, the term of this patent is extended or adjusted under 35 U.S.C. 154(b) by 822 days.

(21) Appl. No.: 18/106,216

(22) Filed: Feb. 6, 2023

(65) Prior Publication Data

US 2024/0263408 A1 Aug. 8, 2024

Related U.S. Application Data

(60) Provisional application No. 63/441,698, filed on Jan. 27, 2023.

(51) Int. Cl.
*E01F 9/685* (2016.01)
*E01F 15/14* (2006.01)

(52) U.S. Cl.
CPC ..... *E01F 9/685* (2016.02); *E01F 15/146* (2013.01)

(58) Field of Classification Search
CPC ..... E01F 9/658; E01F 9/685; E01F 15/146
See application file for complete search history.

(56) References Cited

U.S. PATENT DOCUMENTS

| | | | | |
|---|---|---|---|---|
| 8,684,571 | B1 * | 4/2014 | Alaura | E01F 9/685 362/431 |
| 8,931,937 | B2 * | 1/2015 | Alaura | F21V 29/77 362/431 |
| 11,427,976 | B2 * | 8/2022 | Ustach | E01F 13/00 |
| 11,499,279 | B1 * | 11/2022 | Lamore | E01F 9/685 |
| 11,578,468 | B1 * | 2/2023 | Kramps | E01F 9/685 |
| 12,305,345 | B1 * | 5/2025 | Lamore | E01F 9/685 |

* cited by examiner

*Primary Examiner* — Gary S Hartmann
(74) *Attorney, Agent, or Firm* — Alexander B. Uber; Gray Reed

(57) ABSTRACT

A safety bollard system for stopping a vehicle. The safety bollard system comprises a pipe, a beam, and one or more pieces of rebar. The pipe has an upper portion and a lower portion, with the lower portion of the pipe being secured in the ground and the upper portion extending from the surface of the ground. The lower portion of the pipe comprises an engagement section and a structure section, with the engagement section being positioned below the structure section. The engagement section can include one or more set of opposing apertures. The beam is housed inside of the pipe and extends from a bottom of the structure section and into the upper portion of the pipe. The one or more pieces of rebar can be inserted through the one or more set of opposing apertures, thereby securing the safety bollard system such that the vehicle stops upon impact.

10 Claims, 5 Drawing Sheets

SAFETY BOLLARD

CROSS-REFERENCE TO RELATED APPLICATIONS

Not Applicable.

BACKGROUND

Technical Field

The present disclosure relates to a novel safety bollard system for stopping a vehicle.

Description of Related Art

Bollards are utilized to protect people and buildings from vehicles crashing into them. Bollards are typically utilized in high-traffic areas, such as commercial environments, and buildings that utilize enhanced security. Current bollard systems are constructed of high-strength materials and partially buried underground. To increase the strength of the bollard, end users bury a significant portion of the bollard underground and/or install additional anchor structures around the buried portion of the bollard to increase the structural integrity of the bollard. But the current systems are time-consuming, costly, and complex. Accordingly, there is a need for a bollard system that does not require time-intensive installation, manufacturing, or complex components to increase the structural integrity of the bollard.

BRIEF SUMMARY

Novel aspects of the present disclosure are directed to a safety bollard system. In a non-limiting illustrative embodiment, the safety bollard system comprises a pipe, a beam, and one or more pieces of rebar. The pipe can have an upper portion and a lower portion, with the lower portion of the pipe being secured in the ground. The lower portion of the pipe can comprise an engagement section and a structure section, with the engagement section being positioned below the structure section. The engagement section can include one or more set of opposing apertures. The beam can be housed inside the pipe and can extend from a bottom of the structure section and into the upper portion of the pipe. The one or more pieces of rebar can be inserted through the one or more set of opposing apertures and extend through the pipe, thereby securing the safety bollard system such that the vehicle stops upon impact.

In another non-limiting illustrative embodiment, the safety bollard system can comprise a pipe, an I-beam, and one or more pieces of rebar. The pipe can have an upper portion and a lower portion, with the lower portion of the pipe being secured in the ground. The lower portion of the pipe can comprise an engagement section and a structure section, with the engagement section being positioned below the structure section. The engagement section can include first, second, third, and fourth sets of opposing apertures. The first set of opposing apertures is positioned above the third set of opposing apertures, the second set of opposing apertures is positioned between the first and third sets of opposing apertures, and the fourth set of opposing apertures is positioned below the third set of opposing apertures.

The I-beam can be housed inside the pipe and can extend from a bottom of the structure section and into the upper portion of the pipe. The I-beam can comprise first and second transverse plates and a longitudinal plate, with the longitudinal plate interconnecting the first and second transverse plates. The I-beam can be sized such that the first and second transverse plates engage an internal surface of the pipe. The one or more pieces of rebar can comprise first, second, third, and fourth pieces of rebar. The first piece of rebar is inserted through the first set of opposing apertures, the second piece of rebar is inserted through the second set of opposing apertures, the third piece of rebar is inserted through the third set of opposing apertures, and the fourth piece of rebar is inserted through the fourth set of opposing apertures. The one or more pieces of rebar secure the safety bollard system such that the vehicle stops upon impact.

BRIEF DESCRIPTION OF THE DRAWINGS

The preceding aspects and many of the attendant advantages of the present technology will become more readily appreciated by reference to the following Detailed Description when taken in conjunction with the accompanying simplified drawings of example embodiments. The drawings briefly described below are presented for ease of explanation and do not limit the scope of the claimed subject matter.

DETAILED DESCRIPTION

Figure 1:
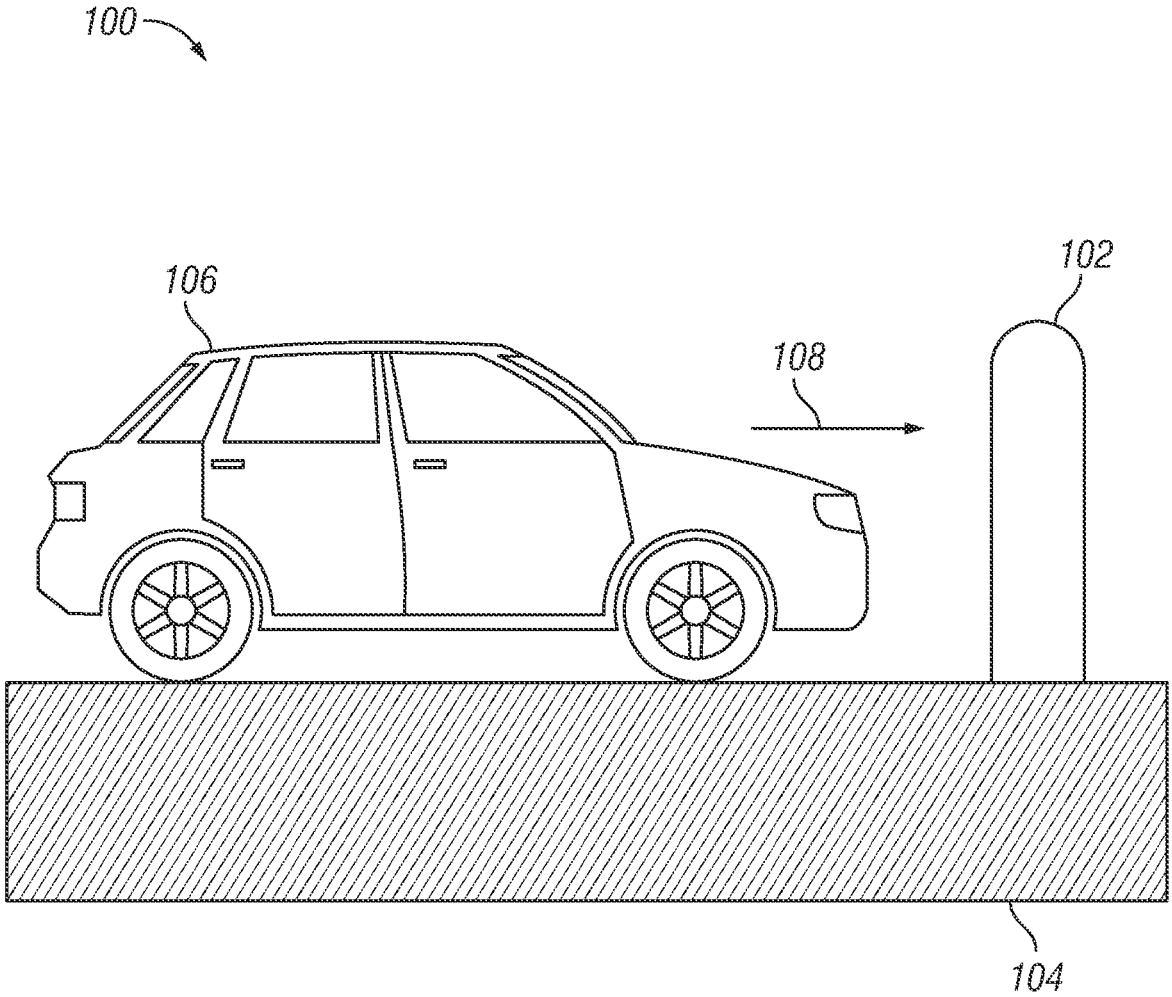
FIG. 1 depicts a safety bollard environment.

FIG. 1 illustrates a safety bollard environment 100. The safety bollard environment 100 includes a safety bollard 102 that is secured into the ground 104. The safety bollard 102 can be sized and structured such that the safety bollard 102 can stop a vehicle 106. In practice the safety bollard 102 functions as a barrier between a vehicle 106 and a structure (not pictured). For example, locations with structures that encounter high volumes of vehicle traffic (e.g., storefronts, gas stations, banks, etc.) may position one or more safety bollards outside of the structures to prevent a vehicle from crashing into the structure. As described in further detail below, the safety bollard can be structured to withstand the impact force 108 of the moving vehicle without breaking or being unearthed and allowing the vehicle to crash into the structure. The safety bollard 102 may be constructed out of any steel, metal, alloy, fiber, compo-site, ceramic, or combination thereof known in the art.

Figure 2:
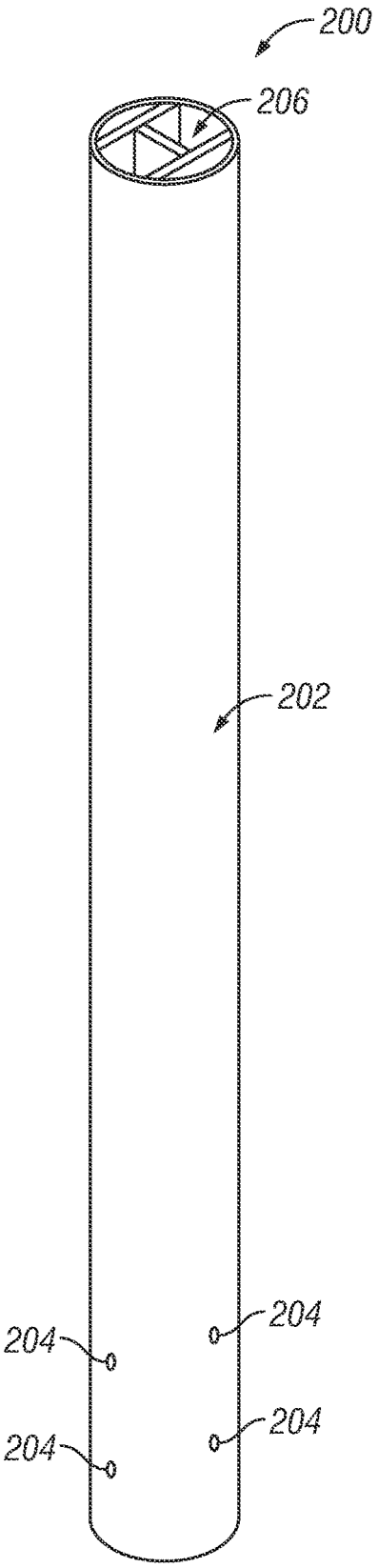
FIG. 2 depicts a perspective view of an illustrative embodiment of a safety bollard.

Turning to FIG. 2, a perspective view of an embodiment of a safety bollard 200 is illustrated. The safety bollard 200 can comprise an I-beam 206 housed within a pipe. In the illustrative embodiment, the pipe 202 can be cylindrical with an internal surface. The lower portion of the pipe 202 can comprise one or more set of opposing apertures 204. The one or more set of opposing apertures 204 can allow pieces of rebar (not pictured) to be inserted through the pipe 202 to increase the security of the safety bollard 200 in the ground. The safety bollard 200 may comprise one or more set of opposing apertures 204. In the illustrative embodiment, the pipe 202 comprises four sets of opposing apertures 204A-204D that are sized and positioned to allow a piece of rebar to be inserted through the pipe 202 and extend across the diameter of the pipe 202. The first set of apertures 204A may be positioned above the third set of apertures 204C, the second set of apertures 204B may be positioned between the first and third sets of apertures 204A, 204C and the fourth set of apertures 204D may be positioned below the third set of apertures 204C. The first and third sets of apertures 204A, 204C may be positioned within a first plane, and the second and fourth sets of apertures 204B, 204D may be positioned within a second plane. In the illustrative embodiment, the first and second planes are non-parallel-preferably substantially perpendicular (90°±15°) whereby the first and third pieces of rebar extend in a different direction than the second and fourth pieces of rebar. Alternatively, the angle (θ) between the first and second planes can be more acute (0°<θ<90°) in circum-stances where the impact force will likely come from a particular direction. It is advantageous to position the one or more set of opposing apertures 204 in such a non-parallel configuration because the structural integrity of the safety bollard system 200 is maximized by the corresponding rebar extending in such configurations.

Figure 3:
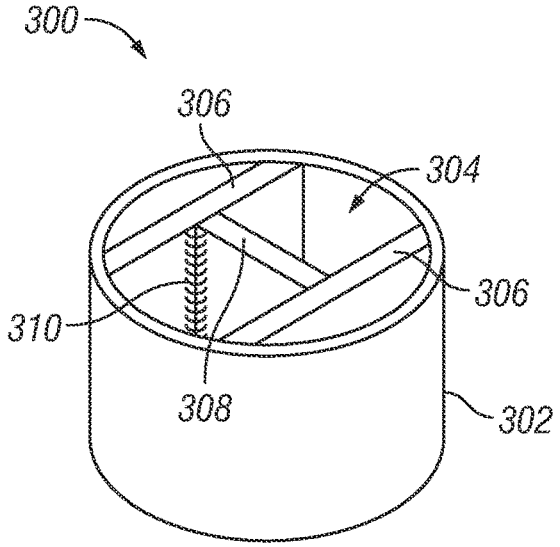
FIG. 3 depicts a perspective view of the top portion of the safety bollard illustrated in FIG. 2 in accordance with an illustrative embodiment.

Referring to FIG. 3, a perspective view of the top portion of the safety bollard 300 from FIG. 2 is illustrated. The I-beam 304 can comprise first and second transverse plates 306, interconnected by a longitudinal plate 308. A seam weld 310 may also be added between the interconnections of longitudinal plate 308 and the first and second transverse plates 306. The first and second transverse plates 306 can be sized such that at least a portion of the first and second transverse plates 306 engage the internal surface of the pipe 302. In the illustrative embodiment, the pipe 302 is cylindrical. Accordingly, the first and second transverse plates 306 may be sized and configured such that the ends of the transverse plates 306 are correspond-ingly angled to the curvature of the internal surface of the pipe 302. Alternatively, the first and second transverse plates 306 may be welded to the internal surface of the pipe 302. It is advantageous to maximize the engagement between the transverse plates and the pipe because it increases the structural integrity of the safety bollard 300 when a vehicle crashes into the safety bollard 300. Additionally, adding seam welds 310 to one or more interfaces of the longitudinal plate 308 and the first and second transverse plates 306 further increases the structural integrity of the safety bollard 300.

Figure 4:
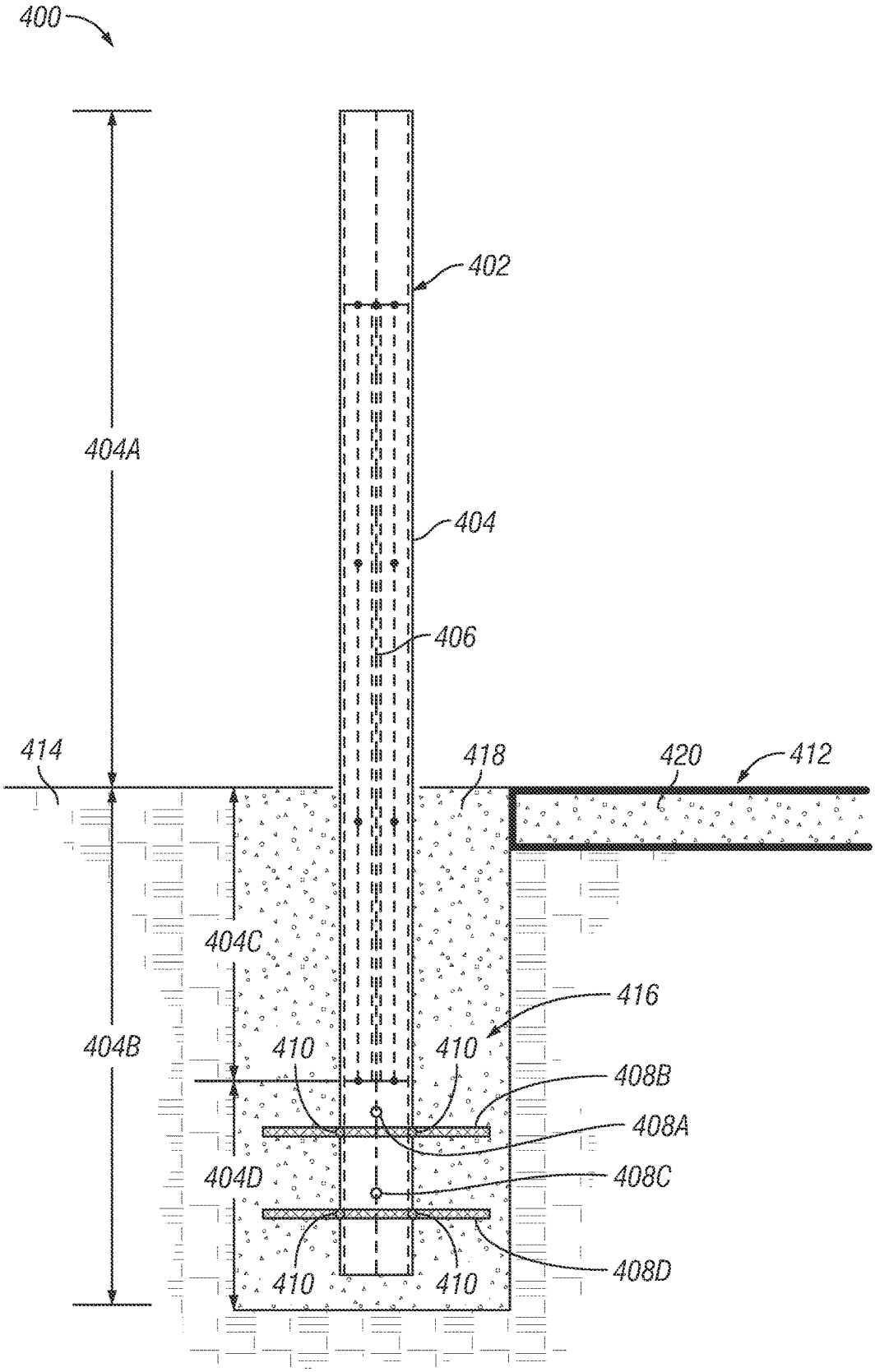
FIG. 4 depicts a cross-sectional view of an illustrative embodiment of a safety bollard system.

With reference to FIG. 4, a cross-sectional view of an embodiment of a safety bollard system 400 is illustrated. The safety bollard system 400 can comprise a safety bollard 402 and a cavity 416 in the ground 414. The safety bollard 402 can comprise a pipe 404, an I-beam 406, and one or more pieces of rebar 408. The pipe 404 may have an upper portion 404A and a lower portion 404B, where the lower portion is secured under the surface of the ground 414 and the upper portion 404A extends out from the surface of the ground 414. The lower portion 404B may include an engagement section 404D and a structure section 404C. The I-beam 406 may comprise first and second transverse plates (see, e.g., FIG. 5, 508) and a longitudinal plate (see, e.g., FIG. 5, 506). The I-beam 406 can be housed inside the pipe 404 and can extend from the bottom of the structure section 402C and into the upper portion 404A of the pipe 402. The engagement section 404D may include one or more set of opposing apertures 410. The pipe 404 may be placed within the cavity 416 such that the bottom of the pipe (i.e., bottom of the engagement section 404D) is flush with the bottom of the cavity 416. The pipe 404 may be secured by filling the cavity 416 with concrete 418, thereby enclosing the external surface of the lower portion 404B of the pipe 404. A slab 412 of concrete 420 may also be positioned on the ground 414 to abut a portion of the cavity 416 adjacent to the second transverse plate (see, e.g., FIG. 5, 508), further securing the safety bollard system 400 such that the vehicle stops upon impact. The strength of the concrete 418, 420 may be about at least 5,000 psi.

In the illustrative embodiment, the one or more set of opposing apertures 410 may comprise first 410A, second 410B, third 410C, and fourth 410D sets of opposing apertures, where the first set of opposing apertures 410A is positioned above the third set of opposing apertures 410C, the second set of opposing apertures 410B is positioned between the first 410A and third 410C sets of opposing apertures, and the fourth set of opposing apertures 410D is positioned below the third set of opposing apertures 410C. The one or more pieces of rebar 408 may comprise first, second, third, and fourth pieces of rebar 408A-408D. The first piece of rebar 408A is inserted through the first set of opposing apertures 410A, the second piece of rebar 408B is inserted through the second set of opposing apertures 410B, the third piece of rebar 408C is inserted through the third set of opposing apertures 410C, and the fourth piece of rebar 408D is inserted through the fourth set of opposing apertures 410D. Each piece of rebar 408 extends through the pipe 402 and out of the one or more set of opposing apertures 410. The first and third sets of opposing apertures 410A, 410C may be positioned within a first plane, and the second and fourth sets of opposing apertures 410B, 410D may be positioned within a second plane. The first and second planes are non-parallel-preferably substantially perpendicular (e.g., 90°±15°) whereby the first and third pieces of rebar 408A, 408C extend in a different direction than the second and fourth pieces of rebar 408B, 408D. It is advantageous to position the one or more pieces of rebar 408 in a non-parallel configuration because the structural integrity of the safety bollard system 400 is maximized.

With continued reference to FIG. 4, the safety bollard system 400 may comprise a variety of size configurations, depending on the needs of the end user. For example, the cavity 416 may have a depth of about 36 inches and a diameter of about 12 inches. In configurations where the cavity is non-circular, the cavity 416 may have a depth of about 36 inches, and a length and width of about 12 inches. The concrete slab 412 may have a thickness (i.e., measured from the top of the cavity downward) of about 4 inches. The dimensions of the safety bollard system 400 may vary within a threshold of 50 percent.

Figure 5:
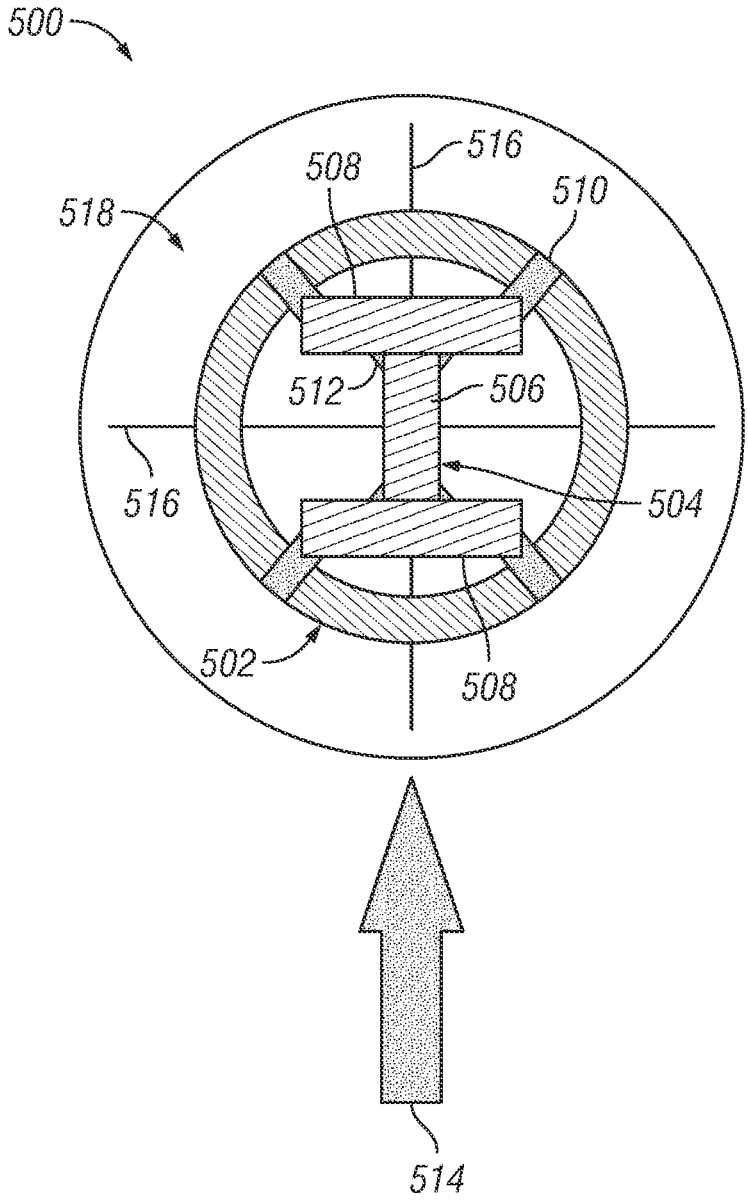
FIG. 5 depicts a plan view of the safety bollard illustrated in FIG. 4 in accordance with an illustrative embodiment.

Turning to FIG. 5, a plan view of the safety bollard system 500 from FIG. 4 is illustrated. An I-beam 504 may be positioned within the cylindrical pipe 502. The pipe 502 may be positioned in the center of the cavity 518. The longitudinal plate 506 bisects the first and second transverse plates 508, forming a ninety-degree angle between the longitudinal plate 506 and the first and second transverse plates 508. A seam weld 512 binds one or more interfaces between the longitudinal plate 506 and the first and second transverse plates 508. The I-beam 504 may be sized and configured such that the outer corners of the first and second transverse plates 508 engage the internal surface of the pipe 502. In the illustrative embodiment, the outer corners of the first and second transverse plates 508 can be engaged to the internal surface of the pipe 502 via plug welds 510. The one or more pieces of rebar 516 are installed within the engagement section (see, e.g., FIG. 5, 404D and 408A-408D) of the pipe 502 arranged in two perpendicular planes. The safety bollard system 500 is positioned such that either the first or second transverse plate 508 receives the impact force 514 of the vehicle. It is advantageous to position the safety bollard system 500 in such a manner because the longitudinal plate 506 provides added reinforcement and de-creases the likelihood that the pipe 502 will break. Additionally, the placement and configuration of the one or more pieces of rebar 516 functions as an anchor, keeping the safety bollard system 500 from being pulled out of the ground. Yet another advantage of the one or more pieces of rebar 516 is that it provides maximum structural integrity without requiring undue manufacturing and installation time. In another embodiment, one or more plates may be welded to the longitudinal plate 506 and interconnect the transverse plates 508. The one or more plates may be positioned at the same position as the plug welds 510.

The pipe 502 may have a thickness of about 0.45 inches, an outer diameter of about 0.45 inches, and an inner diameter of about 4.05 inches. The longitudinal plate 506 and the first and second transverse plates 508 may each of a thickness of about 0.55 inches and a width of about 2.25 inches. Accordingly, the I-beam 504 may extend about 2.75 inches from the first transverse plate 508 to the second transverse plate 508. The circular cavity may have a diameter of about 12 inches. The one or more pieces of rebar 516 may have a length of about 11 inches and a diameter of about 0.5 inches. The one or more plates may have a thickness of about 0.5 inches. The dimensions of the safety bollard system 500 may vary within a threshold of 50 percent.

Figure 6:
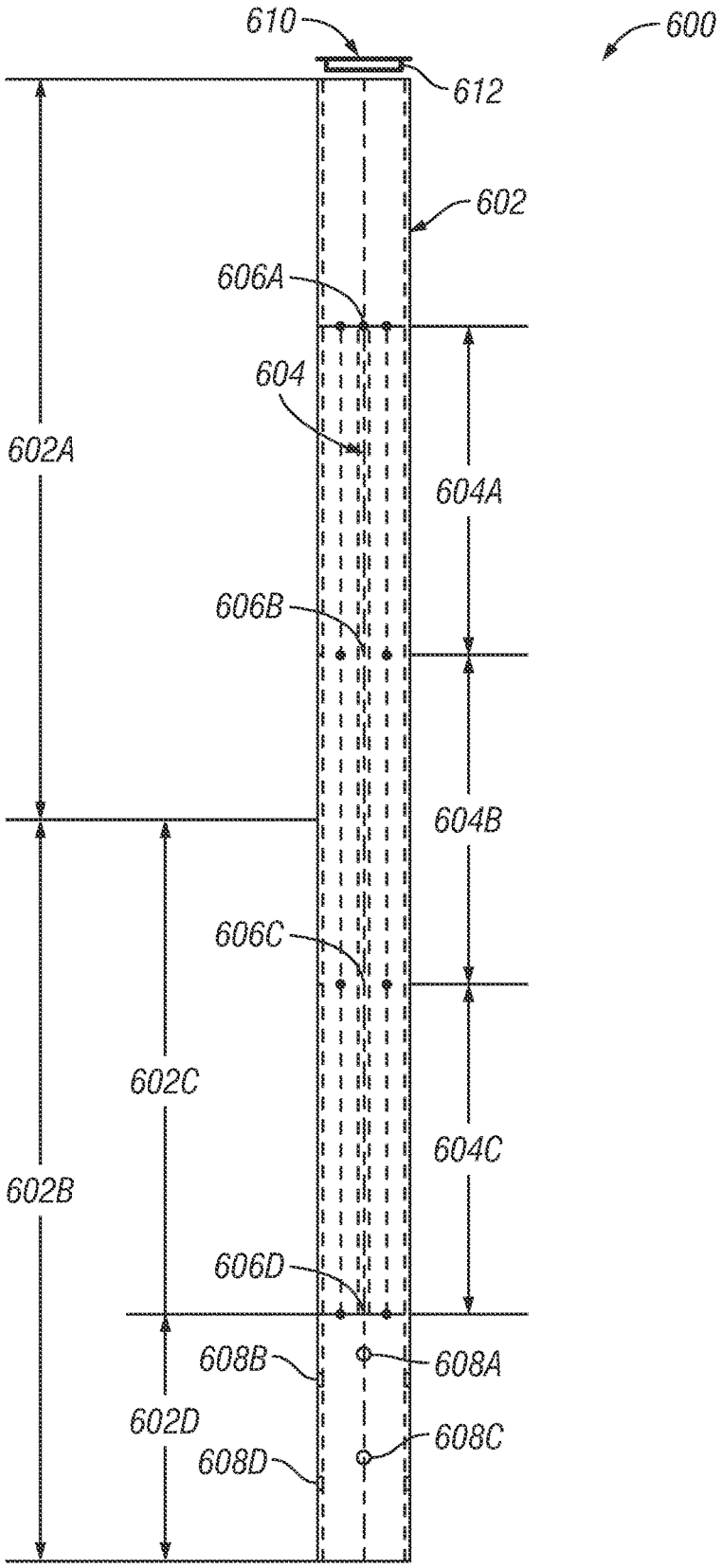
FIG. 6 depicts a cross-sectional view of an illustrative embodiment of a safety bollard.

Referring to FIG. 6, a cross-sectional view of the safety bollard 600 for FIG. 4 is illustrated. The pipe 602 comprises upper portion 602A and a lower portion 602B, where the lower portion 602B is configured to be buried in the ground and the upper portion 602A is configured to extend from the surface of the ground. A cap 610 may be inserted into the top of the upper portion 602A of the pipe 602, enclosing the I-beam 604 within the pipe 602. The cap 610 may include a lip 612 that has a diameter substantially the same as the inner diameter of the pipe 602, sealing the I-beam 604 from the environment and preventing the safety bollard 600 from degrading. The safety bollard 600 may also comprise a cover that surrounds the upper portion of the pipe, thereby enclosing the I-beam 604 inside of the pipe 602. The lower portion 602B of the pipe 602 comprises the engagement section 602D and the structure section 602C of the pipe 602. The I-beam 604 is housed inside of the pipe 602 and extends from the bottom of the structure section 602C and into the upper portion 602A of the pipe 602. In the illustrative embodiment, the I-beam 604 extends less than the full length of the upper portion 602A of the pipe 602. The engagement section 602D includes one or more set of opposing apertures 608A-608D (collectively 608) in the pipe 602, providing for one or more pieces of rebar (not pictured) to be installed through the one or more set of opposing apertures 608 and extend through the pipe 602. According to any embodiment described herein, the engagement section 602D may further include one or more set of channels (not pictured) extending between the one or more set of opposing apertures 608. The one or more pieces of rebar can be installed within the one or more set of channels and extend through the one or more set of opposing apertures 608. The one or more set of channels provides an advantage of streamlining installation of the one or more pieces of rebar through the pipe.

As depicted in FIG. 6, the engagement section 602D comprises first 608A, second 608B, third 608C, and fourth 608D sets of opposing apertures. The first set of opposing apertures 608A is positioned above the third set of opposing apertures 608C, the second set of opposing apertures 608B is positioned between the first 608A and third 608C sets of opposing apertures, and the fourth set of opposing apertures 608D is positioned below the third set of opposing apertures 608C. The first 608A and third 608C sets of opposing apertures are positioned within a first plane, and the second 608B and fourth 608D sets of opposing apertures are positioned within a second plane that is substantially perpendicular (90°±15°) to the first plane. In the illustrative embodiment, the I-beam 604 comprises three sections 604A-604C. Each section 604A-604C of the I-beam 604 is defined by a set of plug welds 606A-606D that secure the I-beam 604 to the inner surface of the pipe 602. The first section 604A of the I-beam is defined by a first set of plug welds 606A and a second set of plug welds 606B. The second section 604B of the I-beam 604 is defined by the second set of plug welds 606B and a third set of plug welds 606C. The third section 604C of the I-beam 604 is defined by the third set of plug welds 606C and a fourth set of plug welds 606D. The I-beam may further comprise one or more plates welded to the longitudinal plate that interconnects the transverse plates. In one embodiment, the I-beam can include four sets of plates that are positioned along the length of the I-beam. Each set of plates can include a plate on both sides of the I-beam. The position of the one or more sets of plates may correspond to the positions of the set of plug welds 606A-606D. The one or more sets of plates provide the advantage of increasing the strength of the bollard without increasing the manufacturing and installation time and costs. For example, the one or more sets of plates reinforce the I-beam and prevent the I-beam from twisting upon impact and causing the bollard to fail.

With continued reference to FIG. 6, the safety bollard 600 may comprise a variety of materials and size configurations, depending on the needs of the end user. For example, the pipe 602 may have a length of about 72 inches. The upper portion 602A of the pipe 602 may have a length of about 36 inches. The lower portion 602B of the pipe 404 may have a length of about 36 inches. The structure section 604C of the pipe 404 may have a length of about 24 inches. The engagement section 604D of the pipe 404 may have a length of about 12 inches. The first set of opposing apertures 608A may be located about 10 inches from the bottom of the engagement section 602D. The second set of opposing apertures 608B may be located about 8.75 inches from the bottom of the engagement section 602D. The third set of opposing apertures 608C may be located about 5 inches from the bottom of the engagement section 602D. The fourth set of opposing apertures 608D may be located about 3.75 inches from the bottom of the engagement section 602D. The I-beam 604 may have a length of about 48 inches, a width of about 2.75 inches, and a thickness of about 2.25 inches. The first, second, and third sections 604A-604C of the I-beam 604 may each have a length of about 16 inches. The dimensions of the safety bollard 600 may vary within a threshold of 50 percent.

Additionally, the section headings herein are provided for consistency with the suggestions under 37 C.F.R. § 1.77 or to provide organizational cues. These headings shall not limit or characterize the invention(s) set out in any claims that may issue from this disclosure. Specifically, and by way of example, although the headings refer to a "Technical Field," the claims should not be limited by the language chosen under this heading to describe the so-called field. Further, a description of a technology as background information is not to be construed as an admission that particular technology is prior art to any embodiment(s) in this disclosure. Neither is the "Summary" a characterization of the embodiment(s) outlined in issued claims.

Furthermore, any reference in this disclosure to "invention" in the singular should not be used to argue that there is only a single point of novelty in this disclosure. Multiple embodiments may be set forth according to the limitations of the multiple claims issuing from this disclosure. Such claims accordingly define the embodiment(s) and their equivalents that are protected thereby. In all instances, the scope of such claims shall be considered on their own merits in light of this disclosure but should not be constrained by the headings set forth herein.

Moreover, the Abstract is provided to comply with 37 C.F.R. § 1.72(b), requiring an abstract that will allow the reader to quickly ascertain the nature of the technical disclosure. It is submitted with the understanding that it will not be used to interpret or limit the scope or meaning of the claims. In addition, in the preceding Detailed Description, it can be seen that various features may be grouped in a single embodiment to streamline the disclosure. This method of disclosure is not to be interpreted as reflecting an intention that the claimed embodiments require more features than are expressly recited in each claim. Instead, as the claims reflect, the inventive subject matter lies in less than all features of a single disclosed embodiment. Thus, the following claims are incorporated into the Detailed Description, with each claim standing on its own as a separate embodiment.

What is claimed is:

1. A safety bollard system for stopping a vehicle, the safety bollard system comprising:

a pipe having an upper portion and a lower portion, wherein: the lower portion is secured under a surface of ground, the lower portion comprises an engagement section and a structure section, the engagement section being positioned below the structure section, and the engagement section includes one or more set of opposing apertures;

a beam housed inside of the pipe, wherein the beam extends from a bottom of the structure section and into the upper portion of the pipe; and one or more pieces of rebar, wherein the one or more pieces of rebar are inserted through the one or more set of opposing apertures and extend through the pipe, thereby securing the safety bollard system such that the vehicle stops upon impact, wherein the one or more set of opposing apertures comprise a first set of opposing apertures, a second set of opposing apertures, a third set of opposing apertures, and a fourth set of opposing apertures, wherein the first set of opposing apertures is positioned above the third set of opposing apertures, the second set of opposing apertures is positioned between the first and third sets of opposing apertures, and the fourth set of opposing apertures is positioned below the third set of opposing apertures, wherein the one or more pieces of rebar comprise a first piece of rebar, a second piece of rebar, a third piece of rebar, and a fourth piece of rebar, wherein the first piece of rebar is installed within the first set of opposing apertures, the second piece of rebar is installed within the second set of opposing apertures, the third piece of rebar is installed within the third set of opposing apertures, and the fourth piece of rebar is installed within the fourth set of opposing apertures, wherein the first and third sets of opposing apertures are positioned within a first plane, and the second and fourth sets of opposing apertures are positioned within a second plane; and wherein the first and second planes are non-parallel such that the first and third pieces of rebar extend in a different direction than the second and fourth pieces of rebar.

2. The safety bollard system of claim 1, wherein the first and second planes are perpendicular to each other.

3. A safety bollard system for stopping a vehicle, the safety bollard system comprising:

a pipe having an upper portion and a lower portion, wherein: the lower portion is secured under a surface of ground, wherein the pipe is cylindrical and has an internal surface;

the lower portion comprises an engagement section and a structure section, the engagement section being positioned below the structure section, the engagement section includes one or more set of opposing apertures;

a beam housed inside of the pipe, wherein the beam extends from a bottom of the structure section and into the upper portion of the pipe, wherein the beam is an I-beam comprising a first transverse plate, a second transverse plate, and a longitudinal plate, further wherein the first and second transverse plates are interconnected by the longitudinal plate, wherein the I-beam is sized such that the first and second transverse plates engage the internal surface of the pipe; and one or more pieces of rebar, wherein the one or more pieces of rebar are inserted through the one or more set of opposing apertures and extend through the pipe, thereby securing the safety bollard system such that the vehicle stops upon impact, wherein the first and second transverse plates have outer corners, wherein the outer corners of the first and second transverse plates engage the internal surface of the pipe, wherein the longitudinal plate bisects the first and second transverse plates, and further wherein the first and second trans-verse plates are positioned perpendicular to an impact force of the vehicle, wherein the outer corners of the first and second transverse plates are engaged to the internal surface of the pipe via plug welds, wherein the longitudinal plate is seam welded to the first and second transverse plates, wherein the pipe is placed in a cavity formed in the ground, the cavity having a depth approximately equal to a length of the lower portion of the pipe, wherein the cavity is filled with concrete such that an external surface of the lower portion of the pipe is enclosed by the concrete, thereby further securing the safety bollard system such that the vehicle stops upon impact, wherein the cavity has a width, wherein the depth of the cavity is greater than the length of the lower portion of the pipe, wherein the cavity is filled with concrete such the lower portion of the pipe is completely enclosed by the concrete, and wherein the one or more pieces of rebar extend approximately the width of the cavity, wherein the one or more pieces of rebar extend less than the width of the cavity, wherein the length of the lower portion of the pipe is less than a length of the upper portion of the pipe, wherein the first transverse plate is positioned adjacent to the impact force of the vehicle, wherein the one or more pieces of rebar extend less than the width of the cavity, and wherein a slab of concrete is positioned on the ground and abuts a portion of the cavity adjacent to the second transverse plate, thereby further securing the safety bollard system such that the vehicle stops upon impact.

4. The safety bollard system of claim 3, further comprising a cover, wherein the cover surrounds the upper portion of the pipe, thereby enclosing the I-beam inside of the pipe.

5. The safety bollard system of claim 3, wherein the I-beam extends less than an entire length of the upper portion of the pipe.

6. The safety bollard system of claim 5, wherein a cap is coupled to an end of the upper portion opposite the lower portion, thereby enclosing the I-beam inside of the pipe.

7. A safety bollard system for stopping a vehicle, the safety bollard system comprising:

a pipe having an upper portion and a lower portion, wherein: the lower portion is secured under a surface of ground, the lower portion comprises an engagement section and a structure section, the engagement section being positioned below the structure section, and the engagement section includes first, second, third, and fourth sets of op-posing apertures, wherein the first set of opposing apertures is posi-tioned above the third set of opposing apertures, the second set of oppos-ing apertures is positioned between the first and third sets of opposing apertures, and the fourth set of opposing apertures is positioned below the third set of opposing apertures;

an I-beam housed inside of the pipe, wherein:

the I-beam extends from a bottom of the structure section and into the up-per portion of the pipe, the I-beam comprises first and second transverse plates and a longitudinal plate, further wherein the first and second transverse plates are inter-connected by the longitudinal plate, and the I-beam is sized such that the first and second transverse plates engage an internal surface of the pipe; and one or more pieces of rebar comprising first, second, third, and fourth pieces of rebar, wherein the first piece of rebar is inserted through the first set of opposing apertures, the second piece of rebar is inserted through the second set of opposing apertures, the third piece of rebar is inserted through the third set of opposing apertures, and the fourth piece of rebar is inserted through the fourth set of opposing apertures, wherein the longitudinal plate bisects the first and second transverse plates, wherein the first and second transverse plates are positioned perpendicular to an impact force of the vehicle, wherein the pipe is cylindrical, wherein the first and third sets of opposing apertures are positioned within a first plane, and the second and fourth sets of opposing apertures are positioned within a second plane, and wherein the first and second planes are perpendicular to each other such that the first and third pieces of rebar extend in a different direction than the second and fourth pieces of rebar.

8. The safety bollard system of claim 7, wherein:

the longitudinal plate is seam welded to the first and second transverse plates; the first and second transverse plates have outer corners; and the outer corners of the first and second transverse plates engage the internal surface of the pipe via plug welds.

9. The safety bollard system of claim 8, wherein:

the pipe is placed in a cavity formed in the ground, the cavity having a depth approximately equal to a length of the lower portion of the pipe; and the cavity is filled with concrete such that an external surface of the lower portion of the pipe is enclosed by the concrete, thereby further securing the safety bollard system such that the vehicle stops upon impact.

10. The safety bollard system of claim 9, wherein:

the cavity has a width, and further wherein the depth of the cavity is greater than the length of the lower portion of the pipe;

the cavity is filled with concrete such the lower portion of the pipe is completely enclosed by the concrete; and the one or more pieces of rebar extend approximately the width of the cavity.

* * * * *